United States Patent [19]

Stout

[11] 4,265,306

[45] May 5, 1981

[54] LATCH FOR WELL TOOLS

[75] Inventor: Gregg W. Stout, Humble, Tex.

[73] Assignee: Otis Engineering Corporation, Dallas, Tex.

[21] Appl. No.: 127,952

[22] Filed: Mar. 7, 1980

[51] Int. Cl.[3] ..... E21B 23/02

[52] U.S. Cl. ..... 166/237; 166/214

[58] Field of Search ..... 166/237, 117.5, 206, 166/214; 294/86.24

[56] References Cited

U.S. PATENT DOCUMENTS

| | | | |
|---|---|---|---|
| 2,401,119 | 5/1946 | Taylor, Jr. | 166/237 X |
| 3,088,521 | 5/1963 | Graves | 166/237 X |
| 3,207,222 | 9/1965 | Tamplen | 166/237 X |
| 3,741,303 | 6/1973 | Terral | 166/237 X |

*Primary Examiner*—William F. Pate, III

*Attorney, Agent, or Firm*—Albert W. Carroll

[57] ABSTRACT

A latch for anchoring well tools in landing receptacles such as nipples or side pocket mandrels in well flow conductors, the receptacles having a locking recess providing a lock shoulder which may be fully annular or only 180 degrees in extent. The latch includes a housing having windows in the wall thereof and a locking lug in each window movable both radially and axially of the housing to engage and disengage the receptacle lock shoulder. A spring biases the lugs downwardly. A lock sleeve slidable on a central core normally holds the lugs against inward movement from expanded locking position and has a recess in its outer surface which allows the lugs to move up and retract thereinto to pass obstructions in a well, the spring returning the lugs to expanded position as soon as such obstruction has been passed. Shearing a pin permits the lock sleeve to be lifted to a position to allow the lugs to retract freely. In a modified embodiment of the invention, the device includes a core which is slidable and which is operationally associated with the well tool supported by the device and performs a function therein.

7 Claims, 7 Drawing Figures

LATCH FOR WELL TOOLS

BACKGROUND OF THE INVENTION

1. Field of the Invention

This invention relates to well tools and more particularly to locking devices and latches therefor.

2. Description of the Prior Art

Latches for locking flow control devices and other well tools in landing receptacles of well flow conductors are well known and usually include expansible and retractable lock means which engage an internal annular or semi-annular lock shoulder formed near the upper end of the landing receptacle bore. Good examples of such latch devices are illustrated and described in U.S. Pat. Nos. 2,690,056, 3,074,485, 3,741,601, and 3,837,398.

U.S. Pat. No. 2,698,056 to S. J. E. Marshall et al. shows a device having a housing provided with windows in the wall thereof, a locking lug in each of the windows movable between retracted and expanded positions, a tubular core secured in the mandrel about the core and slidable between an upper position wherein it allows the lugs to retract and a lower position wherein it locks the lugs in expanded locked position after it has expanded them.

U.S. Pat. No. 3,074,485 shows various latch devices having a lock sleeve mounted for axial movement about a core and adapted to lock and unlock a lock ring which moves between concentric and eccentric positions to lock or unlock the latch in a landing receptacle.

U.S. Pat. No. 3,741,601 shows a latch having a body with a core projecting upwardly. A lock sleeve is mounted about the core for limited axial movement relative thereto and is secured in its lower locking position on the core by a transverse shear pin. A collet having dependent fingers with internal and external bosses formed on the lower ends thereof is disposed about the lock sleeve for limited axial movement thereon. When the collet is in its lower position, the fingers cannot retract to release position. When the lock sleeve is lifted, the collet fingers can retract allowing the latch to be withdrawn from its receptacle.

A similar device is shown in the catalog of GAS LIFT EQUIPMENT AND SERVICES, OEC 5122, published November 1976 by Otis Engineering Corporation, P.O. Box 34380, Dallas, Tex. 75234. It appears on page 35 of that catalog and is designated the "Type T2" latch. The Type T2 latch appears to be an improvement over the latch of U.S. Pat. No. 3,741,601, the improvement appearing to reside in an outer sleeve surrounding the collet and having windows in the wall thereof through which the collet fingers are movable radially outwardly to expanded locking position. This sleeve appears to be integral with the body. In this device the collet fingers can move longitudinally up and down in the windows as well as radially in and out between locked and unlocked positions.

None of the prior art devices discussed above having locking lugs mounted in windows of a tool body for both radial and longitudinal movement between locked and unlocked positions with the lugs being spring-biased downwardly therein to positively move the lugs to locking position.

SUMMARY OF THE INVENTION

The present invention is directed to a latch for locating and locking well tools in receptacles of well flow conductors, the latch having a cylindrical portion extending upwardly with circumferentially spaced windows in the wall thereof, the body having means on its lower end for attachment of a well tool or flow control device thereto; a locking lug mounted in each of the windows for radial movement between retracted and expanded locking positions, the lugs also being mounted for longitudinal (up and down) movement in the windows, spring means for biasing the lugs downwardly in the windows; a core projecting upwardly in the body and extending above the upper end thereof and having a head on its upper end; a locking sleeve mounted about the core and normally in lug engaging position to hold the lugs in expanded, locked position but movable to a higher position on said core out of engagement with the lugs, allowing them to retract to unlocking position; and means releasably securing the locking sleeve in lug engaging position and releasable to permit the sleeve to be moved up out of engagement with the lugs, the lock sleeve having an external annular recess near its lower end into which the lugs, upon encountering an obstruction while being lowered into the well, may retract until such obstruction is passed, after which the spring will push the lugs down again, the sloping lower wall of the locking sleeve recess camming the lugs outwardly to their expanded, locked positions.

An object of this invention is to provide a latch of the character described which locks automatically upon being inserted fully into a proper landing receptacle.

It is another object of this invention to provide a latch of the character described having locking lugs which are mounted in windows for both radial and longitudinal movement therein.

Another object is to provide a latch of the character just described having biasing means and cam means for positively moving the locking lugs to expanded position.

Another object is to provide a latch of the character described having means for positively retracting its lock means during retrieval of the device from the receptacle in which it has been installed.

A further object is to provide a latch for well tools which will anchor a well tool in a receptacle having a lock shoulder extending a full 360 degrees about the receptacle or in a receptacle having a lock shoulder extending only approximately 180 degrees.

Another object of this invention is to provide a latch of the character described having a core which is slidable in the latch body and operationally associated with the well tool suspended from the latch.

A further object is to provide such a latch wherein the slidable core is releasably secured in a position where it is inoperative relative to the well tool and is releasable for movement relative to the well tool to perform a function in the well tool.

Another object is to provide a latch of the character described having means for minimizing entry of debris into its locking mechanism.

Other objects and advantages will become apparent from reading the description which follows and studying the accompanying drawing, wherein:

DESCRIPTION OF THE PREFERRED EMBODIMENTS

Figure 1:
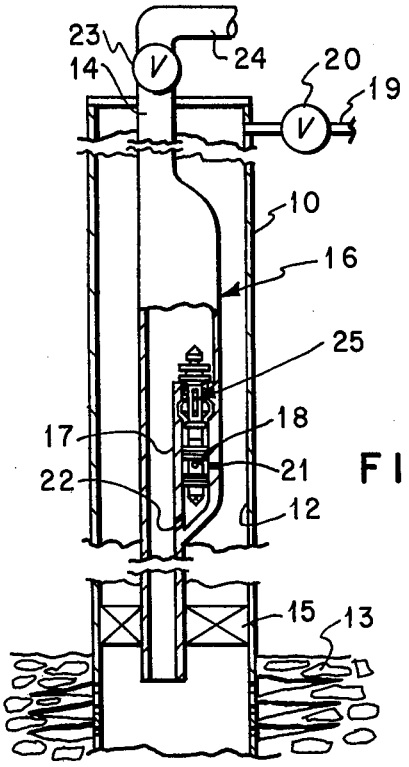
FIG. 1 is a schematical view showing a well having a tubing including a side pocket mandrel having an offset receptacle therein and a latch of this invention locked in the receptacle.

Referring to FIG. 1, it is seen that a well casing 10 is perforated at 11 to provide fluid communication of its bore 12 with the producing formation 13 exterior of the casing. A well tubing 14 is disposed in the casing 10 and a well packer 15 seals between the casing and the tubing 14 so that oil, or well products, entering the casing through perforations 11 and directed to the surface through the tubing 14. The tubing 14 is provided with at least one side pocket mandrel 16 having a side pocket receptacle 17 offset from the main bore of the mandrel and adapted to receive a well tool 18 which may be a flow control device such as a gas lift valve, a check valve, or the like. Assuming that well tool 18 is a gas lift valve, lift gas is injected into the tubing-casing annulus at the surface through input line 19 and valve 20 and flows downwardly therethrough to the side pocket mandrel where it enters the inlet port 21 thereof, and passes through the gas lift valve to exit therefrom in the well-known manner to be injected through outlet port 22 into the oil column inside the tubing to aerate the oil and aid in lifting it to the surface where it is expelled through the Christmas tree valve 23 into the horizontal flow line 24 which leads to suitable collecting facilities for storage or disposition.

Gas lift valve 18 is equipped with a locking device or latch 25 which is shown in greater detail in FIGS. 2–6, which see.

Figure 2:
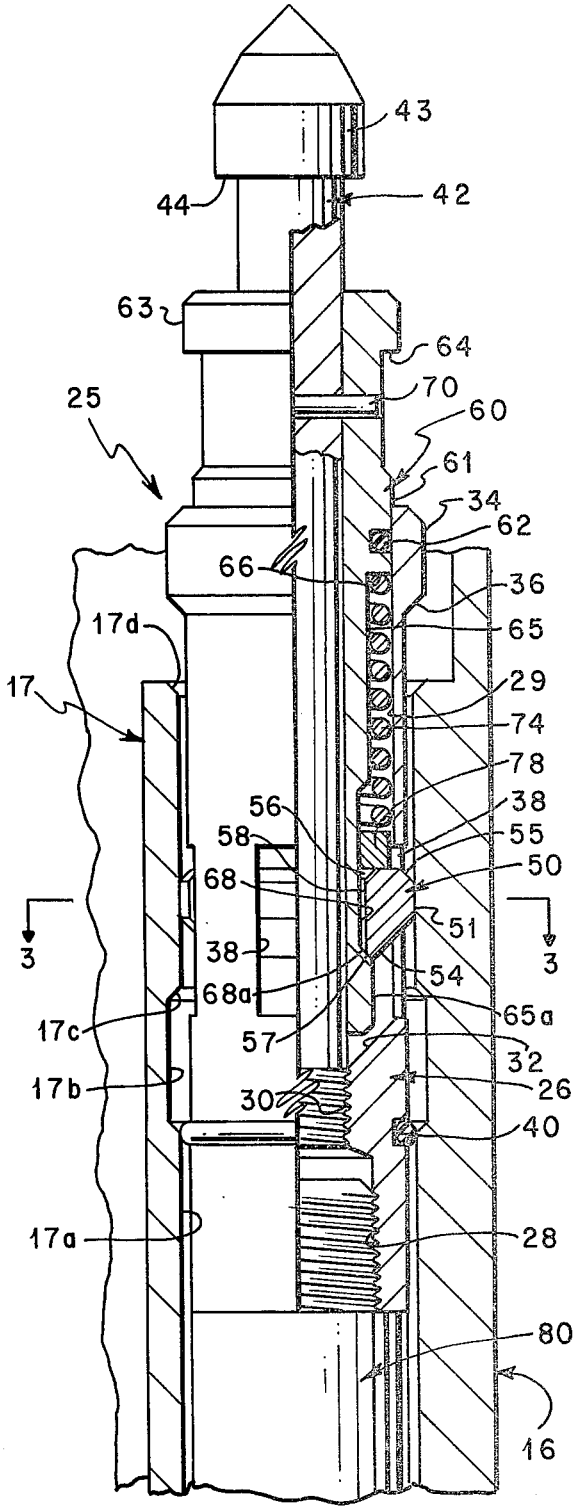
FIG. 2 is a longitudinal sectional view with some parts broken away showing a device embodying this invention partially inserted in a receptacle of a well.

Referring now to FIGS. 2–6, it will be seen that the device of this invention is indicated generally by the numeral 25. It is shown in FIG. 2 being installed in the side pocket receptacle 17 of side pocket mandrel 16 but not yet fully seated therein. The running tool utilized to install the latch is not shown but may be of the type shown in U.S. Pat. No. 3,742,601 to William A. Dudley. Such running tools are well known in the industry.

Latch 25 comprises a body 26 bored and internally threaded at its lower end as at 28 for attachment of a well tool such as well tool 80 and bored from its uppper end to provide enlarged bore 29. Bore 29 is reduced and threaded as at 30. Threaded bore 30 may or may not communicate with bore 28, as desired. The transition from bore 29 to bore 30 provides a cam surface 32 which inclines inwardly and downwardly as shown. The upper end of the body 26 is enlarged as at 34 to provide an external downwardly facing stop shoulder 36. A plurality of windows 38 are formed in the thin wall of the body immediately above the internal cam surface 32, as shown. If desired, a suitable external annular recess can be formed in the body below the windows 38 to receive a suitable resilient ring such as the o-ring 40 or the like. The upwardly extending thin walled cylindrical portion of the body could be made separately and attached to the main body portion by a thread or weld, if desired.

A core 42 is screwed into threaded bore 30 of the body 26 and extends above its upper end and has a head 43 providing a downwardly facing running shoulder 44 which is engageable by releasable means of a running tool (not shown) used to install the device in the receptacle 17, the said running tool forming a part of a tool string lowered into the well, for instance, on a conventional wireline or through use of pumpdown equipment and techniques. The core could be made integral with the body, if desired.

Figure 4:
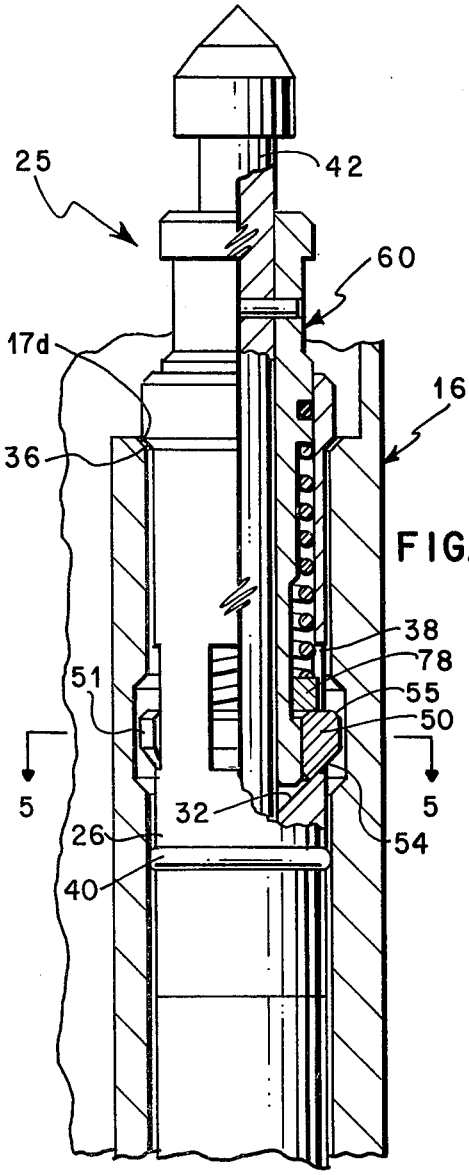
FIG. 4 is a view similar to FIG. 2 showing the device of FIG. 2 locked in the receptacle.
Figure 6:
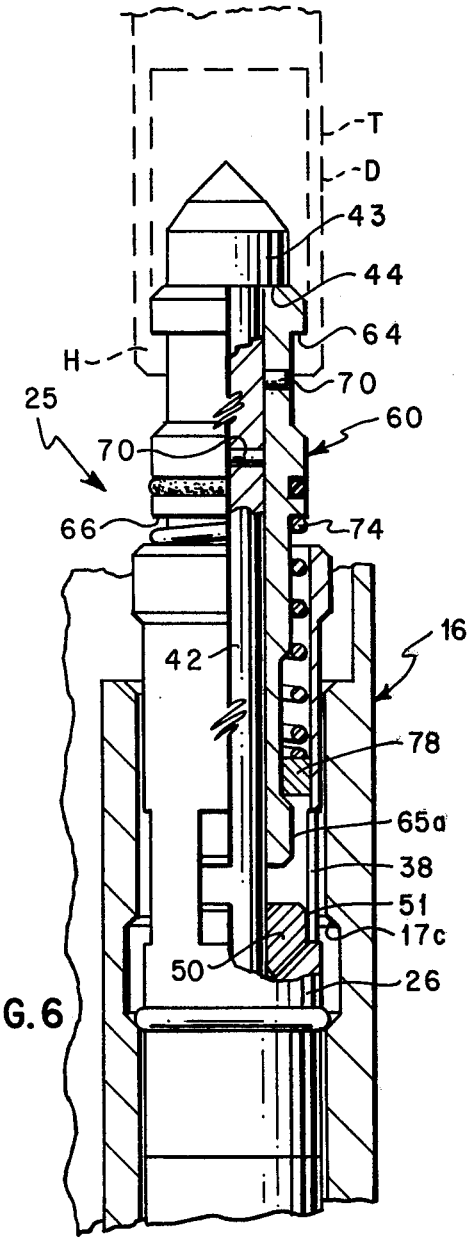
FIG. 6 is a view similar to FIG. 4 showing the device of FIG. 4 released and partially withdrawn from the receptacle.
Figure 3:
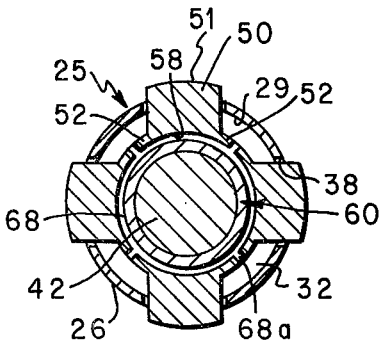
FIG. 3 is a cross-sectional view taken along line 3—3 of FIG. 2.
Figure 5:
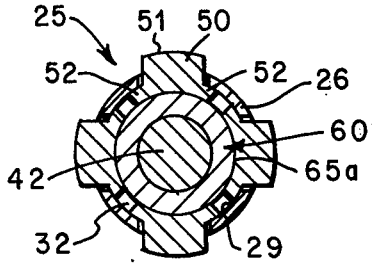
FIG. 5 is a cross-sectional view taken along line 5—5 of FIG. 4.

A locking lug 50 is carried in each window 38 of the housing 26. Each lug 50 is movable radially in its respective window between a retracted position wherein its outward arcuate surface 51 is substantially within the periphery of the body at that location, as shown in FIG. 6, and an expanded locking position wherein its outward surface 51 projects appreciably beyond the periphery of the body at that location, as shown in FIGS. 4 and 5. Each lug is also movable longitudinally (up and down) in the window 38, and this longitudinal movement is independent of the radial movement just mentioned. In FIGS. 2 and 3, the lugs 50 are shown to be in an intermediate position, being retracted only sufficiently to enter the bore 17*a* of the receptacle 17. Outward movement of the lugs 50 in the windows 38 is limited by a pair of lateral wings 52 which extend laterally from each lug, as clearly shown in FIGS. 3 and 5. Each lug 50 is formed with an external cam surface 54 which extends downwardly and inwardly and cooperates with upwardly facing cam surface 32 of the body which tends to cam the lugs inwardly. A similar upwardly facing cam surface 55 is provided at the upper outward corner of the lug which cooperates with the receptacle to cam the lugs inwardly during removal of the latch as will be explained later.

Each lug 50 is also formed with bevels or cam surfaces at its inner upper and lower corners as at 56 and 57, respectively, as clearly shown in FIG. 2. The inner arcuate surface 58 of each lug conforms substantially to the outer surface of lock surface 65*a* of the lock sleeve 60.

A lock sleeve 60 is slidably mounted about the core 42 for limited axial movement relative thereto. Its greatest diameter, at 61, is a free sliding fit in bore 29 of the body and may be provided with a suitable external annular recess in which a suitable resilient ring, such as o-ring 62, may be disposed to engage between the lock sleeve and the body as seen in FIG. 2. The lock sleeve is reduced in diameter a short distance below its upper end to form an external fishing flange 63 providing a downwardly facing fishing shoulder 64 which is engaged by a fishing tool T (represented by dashed lines in FIG. 6) for fishing or retrieving the latch from the receptacle as will be explained later.

The diameter of the lock sleeve is reduced as at 65, providing a downwardly facing abutment shoulder 66. The lower end portion of the reduced diameter portion 65 provides a lock surface 65*a* which supports the lugs 50 against retraction and thus maintains them in expanded locked position, shown in FIG. 4.

An external recess 68 is formed in the outer surface of the reduced diameter portion 65 of the lock sleeve 60 immediately above the lock surface 65*a* to permit the lugs 50 to retract as needed. The lower wall of recess 68 extends outwardly and downwardly to provide a frusto-conical cam surface 68*a* which cams the lugs outwardly as they move downwardly relative thereto in a manner to be more fully described.

The lock sleeve 60 is releasably secured in its lower, locking position about the core 42 by releasable means such as the frangible shear pin 70 disposed in aligned apertures in the lock sleeve and the body as seen in FIGS. 2 and 4. Upward movement of the lock sleeve on the core is limited by engagement of its upper end with the downwardly facing running shoulder 44 of the core.

Biasing means such as the coiled spring 74 is disposed about the core 42 and within the body 26. Its upper end abuts downwardly facing abutment shoulder 66 and constantly biases the lugs 50 downwardly so long as the lock sleeve 60 is in its lower locked position as when shear pin 70 is intact. Since it is possible for the lugs to be moved upwardly into alignment with the recess 68 of the lock sleeve, it is possible for the lower end of the spring to jam between the inner side of the lugs and the outer surface of the lock sleeve at the recess. For this reason, a segmented or split ring 78, which is preferably formed of two halves, is disposed between the lower end of the spring 74 and the upper surface of the lugs. The outside diameter of the split ring is a loose fit in bore 29 of the housing 26 and its inside diameter is loose fit about the lock sleeve in the recess 68. The lock ring is thus confined to the recess 68 since its halves, being confined by the body, cannot separate sufficiently to leave the recess and move to a different position such as a position surrounding lock surface 65*a* of the lock surface. The lower side of the split ring provides a smooth surface to bear against the lugs while permitting them to readily expand and retract as needed.

In assembling the latch 25, the o-ring 62 is installed in the groove of the lock sleeve, the lugs 50 are placed in the windows 38, the spring 74 is placed about the lock sleeve, the two halves of the split ring 78 are placed about the lock sleeve and the spring is compressed until the split ring can be positioned in the lock sleeve recess 68 and, while the split ring is held thus assembled, the lock sleeve-spring-split ring assembly is inserted into the body 26. When the split ring enters the housing, its halves will be confined thereby and it cannot then get out of recess 68. The lock sleeve is then pushed into the body and into position holding the lugs 50 expanded. After the lock sleeve has reached its lowermost position it is turned to align the shear pin holes in the sleeve and core, after which the shear pin 70 is installed.

Before installing the latch in a well, the desired flow control device or well tool 80 is threadedly attached to its lower end and made tight. A suitable running tool (not shown) is attached to the upper end of the latch so that the releasable means (such as shear pin means) of the running tool is engaged with the running shoulder 44 beneath the head 43 of the core 42. The running tool is then attached to the tool string (wireline tool string or other suitable tool string such as a pump down tool string used in TFL operations common in the industry where underwater wells are located).

Since the latch 25, as illustrated so far, is to be installed in the offset receptacle of a side pocket mandrel, the running tool will be a part of or attached to a suitable kickover tool such as that illustrated in U.S. Pat. No. 3,074,485 to H. E. McGowen, Jr. mentioned above or in U.S. Pat. No. 3,876,001 to William B. Goode.

It is understood that the latch 25 can support a well tool in either a landing receptacle which is concentric with the well tubing or in an offset receptacle of various types of side pocket mandrels, a schematic side pocket mandrel being illustrated and described herein.

The latch 25 is lowered into the well and inserted in the landing receptacle in the well-known and conventional manner. As the latch enters the receptacle the lugs so being expanded lodge at the top of the receptacle while the latch continues downward therein. When the lock surface 65*a* of the lock sleeve moves to a location below the lugs, the lugs begin to retract, their lower inner cam surface 57 riding upwardly and inwardly along expander surface 68*a* defining the lower wall of recess 68. When the lugs have retracted sufficiently, they enter the receptacle bore and the latch continues downwardly therein as shown in FIG. 2. When, during such downward movement of the latch 25 through the landing receptacle the lugs become aligned with the receptacle locking recess 17*b*, the lugs, being biased downwardly by the spring 74, will move downwardly and outwardly, being cammed outwardly by the cam surface 68*a* which defines the lower limit of recess 68 of the lock sleeve 60. Thus, the lugs will move outwardly until they can move down over lock surface 65*a* of the lock sleeve and move down until stopped by their engagement with the internal cam surface 32 in the body. The spring will thus continue to bias the lugs downwardly and hold them in locked position. Of course, as the lugs moved to expanded, locked position, their outer portions moved outwardly into the locking recess 17*b* to lock the latch in the receptacle. The latch thus becomes automatically locked in the receptacle merely by inserting it sufficiently far thereinto.

The latch 25 can be moved downwardly in the receptacle until the downwardly facing stop shoulder 36 near the upper end of the body engages the chamfer 17*d* surrounding the upper end of the receptacle bore 17*a*.

Should the latch 25, for any reason, be moved upwardly after being lockingly engaged therein as just explained, the lugs 50 which extend into the receptacle's locking recess 17*b* will engage the downwardly facing lock shoulder 17*c* which defines the upper limit of locking recess 17*b* and preclude further upward movement of the latch.

Thus, the latch 25 is locked in the receptacle 17, as shown in FIG. 4, and cannot be displaced therefrom in either longitudinal direction since the lugs 50 cannot move upwardly past locking shoulder 17*c* and the engagement of stop shoulder 36 of the body with the chamfer 17*d* at the upper end of the receptacle bore limits downward movement of the latch.

When it is desired to remove the latch and well tool from the well, a suitable retrieving or pulling tool, represented in dashed lines in FIG. 6 and indicated by the letter T, is used. One suitable pulling tool is that disclosed in U.S. Pat. No. 2,605,131 to S. J. E. Marshall, et al. and available from Otis Engineering Corporation, Dallas, Tex. 75234.

Pulling tool T is provided with dogs D having hooks H on their lower ends which are engageable with the fishing shoulder 64 of the lock sleeve 60 of the latch 25.

The pulling tool T is lowered into the well on a tool string like that used in installing the latch and well tool and using the same means, either wireline or pumpdown equipment and techniques.

The pulling tool is lowered into the well and engaged with the latch 25, the hooks H of the pulling tool engaging the fishing shoulder 64 of the lock sleeve. Upward forces are then applied to the lock sleeve to shear the shear pin 70 and lift the lock sleeve to its upper unlocked position, shown in FIG. 6, in which position the locking surface 65a of the lock sleeve is above the lugs 50 which renders them free to retract to the position shown, permitting the latch and well tool to be withdrawn from the receptacle and from the well.

Should the lugs for any reason fail to immediately retract when the lock surface 65a moves out of the way, upward movement of the latch brings the upper outwardly facing cam surface 55 of the lugs into engagement with the locking shoulder 17c of the receptacle's locking recess and the camming action between these two parts forces the lugs to retract. This retraction of the lugs may be further aided by the inner cam surface 32 in the body coacting with the lugs' lower outwardly facing cam surface 54 to cam the lugs inwardly if necessary. Thus, the lugs will be positively retracted to permit withdrawal of the latch 25, and the well tool 80 carried thereby, from the receptacle 17.

Figure 7:
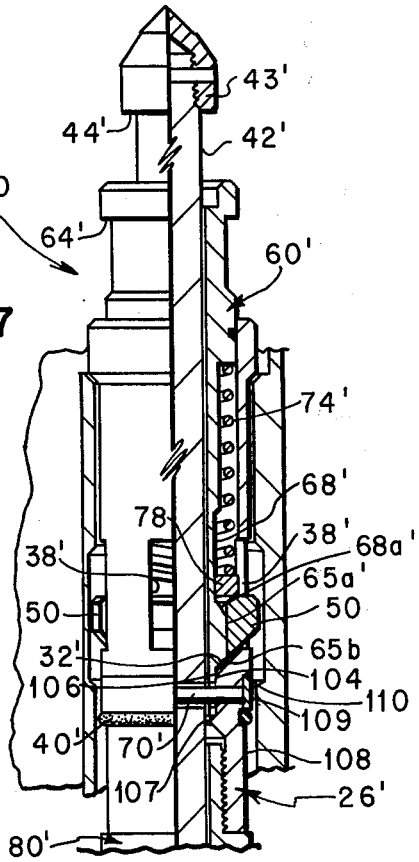
FIG. 7 is a view similar to FIG. 4 showing a modified form of this invention.

Another preferred embodiment of this invention is illustrated in FIG. 7 where it is indicated generally by numeral 100. Latch 100 is very similar to latch 25 and operates in the same manner, with one addition. In latch 100, the core 42' extends upwardly through the modified latch body 26' and is provided with a head 43' threadedly attached thereto. The lower end of the core is operationally associated or connected with the well tool 80' suspended from the latch. The core 42' is slidably mounted in the bore 107 of body 26' and therefore slidable relative to well tool 80'. It is secured in the body below the windows by a shear pin 70' disposed in aligned apertures in the core and the body. The core is thus secured in the position shown in FIG. 7. The lower portion (not shown) of the core 42' may be connected to an equalizing valve, or the like, which forms a part of well tool 80' which may be an equalizing dummy valve used to sealingly cover inlet port 21 of the side pocket mandrel until the time when it is needful to replace it with a gas lift valve or other well tool. When the core 42' is forced downwardly in the body, shearing the pin 70', the downward movement of the core relative to the well tool 80' is effective to perform a function such as opening an equalizing passage through the well tool or perform some other function. Means (not shown) in the well tool 80' limits upward movement of the core to the position shown in FIG. 7.

The modified lock sleeve 60' is formed with a recess 68', an expander surface 68a', and a lock surface 65a therebelow, and with a reduced diameter dependent extension 104 extending downwardly in the enlarged portion 106 of bore 107 of the body 26'. The reduced portion 104 also provides a sloping downwardly facing shoulder 65b which normally engages the inner cam surface 32' in the body 26' as shown to make it impossible to shear the pin 70' by downward forces applied to the lock sleeve. This extension 104 of the lock sleeve is provided with a pair of oppositely located apertures through which the shear pin 70' is installed, as shown. The shear pin 70' thus releasably holds both the core and the lock sleeve secured against axial movement relative to the body. However, it is readily seen that when the core 42' is forced down to shear the pin 70' and perform its function in the well tool 80', the pin 70' shears at a location between the outside diameter of the core and the inside diameter of the lock sleeve, leaving the lock sleeve as yet secured to the body.

The lower portion of the body 26' is reduced in diameter as at 108 and a thin wall ring or cover 109 is placed about that reduced diameter portion and moved upwardly to the position shown where it is against the downwardly facing shoulder 110 of the body and covers the ends of the shear pin 70' to prevent fragments thereof from falling out of the latch and causing trouble. The cover 109 is held in place by o-ring 40' disposed in a suitable external recess whose upper edge is approximately even with the lower edge of the cover as shown. The o-ring 40', of course, also serves the same function as does its counterpart, o-ring 40, of latch 25 previously described in that it engages between the body 26' and the inner wall of the receptacle to prevent debris from moving therepast into the lock mechanism.

The latch 100 is installed in exactly the same manner as is the latch 25 previously described, but care is taken to make certain that the running tool cannot drive the core down and shear the pin 70'. Such would abort the mission. The running tool should apply its downwardly directed driving force to the lock sleeve, or to the body, or, ideally, to both. Upwardly directed forces for releasing the running tool from the latch should be applied to the head 43' through the running shoulder 44' since the shear pin 70' cannot be sheared by upward forces applied to the core 42'.

To retrieve the latch 100 and the well tool 80' attached thereto, a suitable pulling tool such as the pulling tool of U.S. Pat. No. 2,605,131 mentioned above is used.

The pulling tool (not shown) is lowered into the well on a tool string like that used in installing the latch in the receptacle. The pulling tool dogs (not shown) engage the fishing shoulder 64' of the lock sleeve 60', and the pulling tool core (not shown) of the pulling tool abuts the head 43' of the latch core 42'. Downward force is applied to the pulling tool to force the latch core 42' down to shear the pin 70' and perform a function in well tool 80' such as equalizing the pressures thereacross. After such function has been performed and pressures are stabilized, upward force is applied through the pulling tool to the lock sleeve to shear the pin 70' again and force the lock sleeve and core to their upper positions. With the lock sleeve in its thus upper position, the lock surface 65a' is no longer effective to maintain the lugs 50' expanded, so they are free to retract, and further upward force applied by the pulling tool withdraws the latch 100 from the bore of the receptacle for removal from the well.

Some receptacles, particularly those in some side pocket mandrels, are provided with locking shoulders which do not surround the receptacle bore completely but extend through an arc of only about 180 degrees or slightly less. The latch devices 24 and 100 described hereinabove are suitable for use in such receptacles as well as those earlier described receptacles having lock shoulders of the conventional 360-degree type.

Thus, it has been shown that a new latch and one modification thereof have been provided which are useful in anchoring a well device in a well; that the devices can be installed in conventional concentric landing receptacles or in the offset receptacles of side pocket mandrels; that the latches are compatible with receptacles having conventional 360-degree locking shoulders as well as those having locking shoulders which are of the 180-degree type; that the latches can be installed in wells and removed therefrom through use of conventional equipment and techniques, such as wireline and pumpdown (TFL); that the lugs of these latches are positively disengaged from the receptacle locking recess and retracted; and that seal rings are provided where practicable to prevent debris or the like from entering the locking mechanism of the latch.

It should be understood that the core 42 of the latch 25 may be made in tubular form and that the body 26 may be provided with a central flow passage should it be desirable to provide a flow passage through the latch. This is desirable if certain well tools are to be used with this latch.

Further, it is understood that the core may be formed integral with the body if desired.

The foregoing description and drawings of the invention are explanatory and illustrative only, and various changes in sizes, shapes, materials, and arrangement of parts, as well as certain details of design and construction, may be made within the scope of the claims appended hereto without departing from the true spirit of the invention.

What I claim is:

1. A latch for securing well tools in a landing receptacle of a well flow conductor having a locking recess therein providing a downwardly facing lock shoulder, comprising:

a. a body having a bore and a plurality of circumferentially spaced windows communicating said bore with the exterior of said body, said body having means at its lower end for attachment to a well tool;

b. a core in said bore of said body secured at a location therein below said windows and having its upper end extending above said body, said core having a head thereon providing a downwardly facing shoulder engageable by a running tool, said body and said core forming an annular space therebetween;

c. a locking lug disposed in each of said windows of said body and movable radially therein between inner retracted positions and outer expanded locking positions wherein they are engageable with the downwardly facing lock shoulder of said receptacle, said lugs being additionally movable longitudinally in said windows independently of said radial movement;

d. a lock sleeve slidably mounted about said core and having a flange at its upper end providing a downwardly facing fishing shoulder and a portion of said sleeve initially extending into said body to a point near the lower ends of said windows and having a lock surface thereon engageable with the inner surfaces of said locking lugs to maintain the lugs in expanded locking position, said sleeve having an external annular recess above said lock surface and a downwardly facing abutment shoulder intermediate said recess and said fishing shoulder, said sleeve being movable to an upper unlocking position wherein the lower end of said sleeve is above said lugs and said lugs are movable to retracted unlocked position;

e. spring means disposed about said lock sleeve with the upper end thereof engaging said abutment shoulder, said spring means biasing said lugs downwardly in said windows, said lugs being movable upwardly against the force of said spring means to a position where they can retract into said external recess of said lock sleeve; and f. means releasably securing said sleeve in its lower locked position supporting said lugs in expanded position and being releasable by upward force applied to said sleeve to move said sleeve to its upper position allowing said lugs to move inwardly to retracted position.

2. The latch device of claim 1, wherein a. said lugs are provided with lateral wing portions to limit outward movement of the lugs in said windows; and b. said lock sleeve is formed with an external annular downwardly facing shoulder near its upper end engageable by a fishing tool.

3. The latch device of claim 2, wherein said body is formed with an enlargement spaced above said windows providing a downwardly facing stop shoulder engageable with said landing receptacle to limit downward movement of said latch therein.

4. The latch device of claim 3, wherein a. said spring means is a helical coil spring, and b. said releasable means securing said lock sleeve on said core is a shear pin disposed in aligned apertures in said core and said lock sleeve.

5. The latch device of claim 4, wherein said lock sleeve is formed with an external annular groove above said abutment shoulder thereon and a resilient ring is disposed therein to engage between said lock sleeve and said body to prevent debris from moving therepast into said annular space, and said body is formed with an external annular recess below said windows and a resilient ring is disposed therein to engage between said body and said receptacle below said recess to prevent debris from passing upwardly therepast into said annular space.

6. The latch device of claim 4, including a segmented ring interposed between said spring and said locking lugs, said ring being engaged in said recess in said lock sleeve at all times.

7. The latch device of claim 1, 2, 3, 4, 5, or 6, wherein said core slidably extends through said body and is operationally connected to the well tool suspended from said latch, said core being releasably secured to said body below said windows by said releasable means, said releasable means releasing said core upon application of a downward force of sufficient magnitude to said core; said lock sleeve is formed with a depending extension having a pair of opposing appertures in the wall thereof; and said releasable means also engaging said pair of opposing apertures in said lock sleeve, said releasable means releasing said lock sleeve upon application of an upward force of sufficient magnitude to said lock sleeve to permit said lock sleeve to be moved to a position allowing said lugs to retract fully.

* * * * *

UNITED STATES PATENT AND TRADEMARK OFFICE

CERTIFICATE OF CORRECTION

PATENT NO. : 4,265,306

DATED : May 5, 1981

INVENTOR(S) : Gregg W. Stout

It is certified that error appears in the above—identified patent and that said Letters Patent is hereby corrected as shown below:

Column 3, line 24, for "and" read --are--.

Column 6, line 6, for "so" read --50--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*